United States Patent [19]

Sterne

[11] 3,943,648

[45] Mar. 16, 1976

[54] TRANSPARENT SIGN DISPLAY FOR SUPERIMPOSING TRANSPARENT SIGN WITH PRINTED MESSAGE ON BACKGROUND DISPLAY

[75] Inventor: Karl E. Sterne, San Francisco, Calif.

[73] Assignee: Optical Sciences Group, San Rafael, Calif.

[22] Filed: Mar. 5, 1975

[21] Appl. No.: 555,503

[52] U.S. Cl. ..... 40/106.51; 40/137

[51] Int. Cl.[2] ..... G09F 19/02

[58] Field of Search ..... 40/125, 137, 135, 106.51; 350/211; 272/8 M, 8 D

[56] References Cited

UNITED STATES PATENTS

| | | | |
|---|---|---|---|
| 1,600,327 | 9/1926 | Evans | 40/125 R |
| 2,521,558 | 9/1950 | Alvarez | 40/154 X |
| 3,661,385 | 5/1972 | Schneider | 350/211 X |
| 3,691,663 | 9/1972 | Caven | 40/125 R |
| 3,861,785 | 1/1975 | Barbour | 350/211 |

FOREIGN PATENTS OR APPLICATIONS

| | | | |
|---|---|---|---|
| 312,961 | 6/1929 | United Kingdom | 40/125 L |

*Primary Examiner*—Louis G. Mancene
*Assistant Examiner*—Wenceslao J. Contreras
*Attorney, Agent, or Firm*—Townsend and Townsend

[57] ABSTRACT

An advertising message is placed upon the planar surface of a thin negative lens, preferably of fresnelled construction. The lens is, in turn, placed upon a window, preferably a store front window affording a view to a background merchandising display. When viewed by passersby (preferably pedestrian traffic), differential angular movement of the store front display in the negative lens to the store front display out of the negative lens results. This causes differential apparent angular motion to the viewer and draws immediate attention to the lens and its message. For store front traffic passing relatively close to the window, both the display and the message as viewed by the passersby become simultaneously visible due to two effects. First, the negative fresnelled lens makes the display (as viewed through the lens) and the message appear with a minimum depth of field differential. The ambient depth of field of the human eye of the passerby accommodates both the message and the display when viewed through the fresnelled lens. Second, the negative lens compresses what would otherwise be the natural binocular parallax effect of the human eyes. Thus, suppression of either the background in favor of the message, or the message in favor of the background, does not occur, making both message and display simultaneously visible.

2 Claims, 1 Drawing Figure

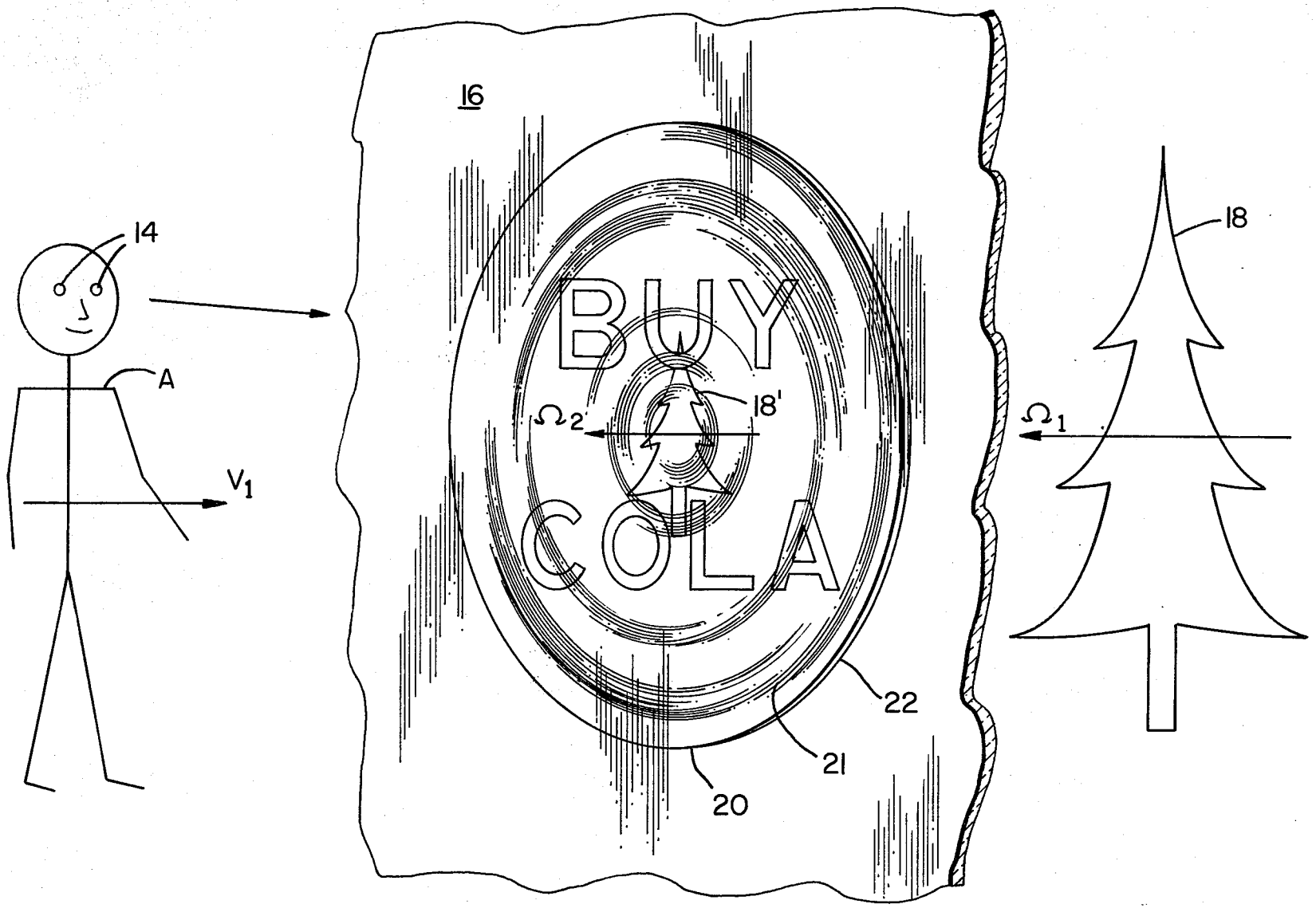
18
$\Omega_1$
16
BOLA
18'
$\Omega_2$
22
21
20
14
A
$V_1$

TRANSPARENT SIGN DISPLAY FOR SUPERIMPOSING TRANSPARENT SIGN WITH PRINTED MESSAGE ON BACKGROUND DISPLAY

This invention relates to advertising displays. Specifically, it relates to a display with a message imprinted on a negative fresnelled lens.

SUMMARY OF THE PROBLEM

Messages printed on transparent glass are often difficult to see and understand. This is because a viewer (for example, a sidewalk passerby observing a store front window) must select between either observing the message on the plane of the window or observing the background display.

When the viewer chooses to observe the background display, several phenomena can occur to suppress the messages appearing in the plane of the window. First, assuming the viewer observes the display while walking by, both the message and background display will assume angular velocities with respect to the viewer's eyes which are normal for stationary objects. The viewer will thus have no cause to have his eye particularly drawn to the advertising message.

Second, upon observing the background display, the advertising message in the plane of the window will appear with a double image. This being the case, the perceptive psychology of the viewer will naturally suppress the advertising message.

Finally, and assuming the viewer is within a relatively close distance (e.g., 3 feet) of the window, the depth of field between the lettering and the background display will require that the viewer's eyes focus in on either the message or the background display, but not both.

SUMMARY OF THE INVENTION

An advertising message is placed upon the planar surface of a thin negative lens, preferably of fresnelled construction. The lens is, in turn, placed upon a transparent panel, preferably a store front window affording a view to a background merchandising display. When viewed by passersby (preferably pedestrian traffic), differential angular movement of the store front display in the negative lens to the store front display out of the negative lens results. This causes differential apparent angular motion to the viewer and draws immediate attention to the lens and its message. For store front traffic passing relatively close to the window, both the display and the message as viewed by the passersby become simultaneously visible due to two effects. First, the negative fresnelled lens makes the display (as viewed through the lens) and the message appear with a minimum depth of field differential. The ambient depth of field of the human eye of the passerby accommodates both the message and the display when viewed through the fresnelled lens. Second, the negative lens compresses what would otherwise be the natural binocular parallax effect of the human eyes. Thus, suppression of either the background in favor of the message, or the message in favor of the background, does not occur, making both message and display simultaneously visible.

DESCRIPTION OF THE DRAWING

The FIGURE is a schematic view of a negative fresnelled lens with an advertising message imprinted thereon, the fresnelled lens being attached to a window and having a background display in the form of a tree in a store front window visible to a pedestrian passerby.

DESCRIPTION OF THE PREFERRED EMBODIMENT

Referring to the FIGURE, a passerby A views through his eyes 14 a store front window 16 having a background display 18 in the form of a tree.

Attached to the store front window is a negative fresnelled lens 20 having a focal length of minus 1 foot.

Lens 20, without the advertising message thereon, is a standard item of manufacture. Specifically, the preferred embodiment of such a lens is typically plasticized polyvinyl chloride having sufficient flexibility to be easily folded and easily conformed to and stuck on a window. Preferably, one side of the lens is optically flat; the remaining side of the lens defines concentric fresnel corrugations, each corrugation having a spatial interval of 0.024 inch taken along a radius of the lens. The lens is preferably spherical and constructed with a focal length of minus 12 inches, but negative lenses with focal lengths in the range of minus 3 inches to minus 3 feet can suffice for the practice of this invention. Other negative focal lengths can be used. Typically, the lens is circular and 12 inches in diameter, although these specific dimensions are not required.

Lens 20 is preferably fastened at its unfresnelled surface 21 to the inside of window 16. The message is preferably printed on the flat surface of the lens. Its fresnelled surface 22 is preferably exposed outwardly from the window and towards the store display in the form of tree 18.

Having set forth the construction of the lens, the rather subtle viewing effect of this invention can be understood.

First, it should be understood that the eyes 14 and the viewing senses of viewer A will be drawn to objects having angular motion differing from that of a stationary background. This psychological phenomenon can easily be recalled. For example, in a case of hide and go seek, where a player in a forest steps out from behind a tree, his motion relative to the rest of the forest will cause the players of the game to draw their attention immediately to the visible and moving participant.

The advertising phenomenon of the lens subtly uses this principle. Specifically, viewer through eyes 14 will see through window 16 the display of the tree 18. Simultaneously, he will view through the lens the reduced image of the display 18′.

Assuming that passerby A is walking past the display with a velocity $V_1$, the background display as viewed through the window will move at a velocity $\Omega_1$. This velocity will be angular and relative to the viewer.

Unlike the background display as viewed through the window, the display 18′ as viewed through the lens will move at a different and slower angular velocity $\Omega_2$.

It is in the nature of the human vision psychology that the attention of the viewer will be immediately drawn to the advertising message imprinted on the back of the fresnelled lens here shown as the hypothetical script "BUY COLA" because of these differing angular velocities.

Assuming that passerby A is relatively close to the window 16 (as in the case of a pedestrian passerby at the store front window) two other more subtle phenomena can occur.

First, where the passerby is relatively close to the window and views with typical binocular vision the advertising message display, he will typically view the message or the display, but not both. This is because when he views either the advertising message or the display, a double image of the respective display or advertising message will occur. He will psychologically tend to suppress the double image so that only one image in fact comes into view.

The angular effect of the negative fresnelled lens will tend to suppress this double vision phenomenon. Thus, the image 18' and message as imprinted on the fresnelled lens will be simultaneously in view.

Additionally, and where the viewer is within approximately 3 feet of the store front window, his eyes will have a finite depth of field when focused. Assuming that the negative fresnelled lens is not mounted to the window, the ambient depth of field of the viewer's eye will typically either focus on the message on the window, or alternately the background display, but not both.

When the viewer focuses on the message, a completely different phenomenon will occur. The negative fresnelled lens, which preferably has a focal length of minus 1 foot, will draw the background display to an apparent image location which is only slightly less than 1 foot from the lens. In this location, the apparent distance between the advertising message on one hand, and the image 19' on the other hand, will be such that both message and display, when viewed through the lens, will be simultaneously in view.

It will thus be seen that the described invention presents from at least three different aspects some rather subtle optical effects. First, it provides differential movement of the image in the display with respect to its background which psychologically draws the eyes of the viewer to the display. Second, it suppresses the natural parallax effect of the eyes so that both message and background display are simultaneously in view. And third, it provides both the background display and message with a superimposed depth of field, making both simultaneously visible to a passerby.

I claim:

1. A transparent advertising display for placement on a transparent panel having a background display comprising: a negative fresnelled lens having a first fresnelled side and a second planar side; a message imprinted on the planar side of said negative fresnelled lens, the planar side of said negative fresnelled lens being fastened to the glass of said store front display.

2. The invention of claim 1 and wherein the focal length of said lens is in the range of minus 3 feet to minus 3 inches.

* * * * *